United States Patent [19]

Kruse et al.

[11] Patent Number: 4,760,746

[45] Date of Patent: Aug. 2, 1988

[54] TORQUE TO YIELD INDICATOR AND METHOD

[75] Inventors: Gregory M. Kruse, Morton Grove; Harold P. Patton, Crystal Lake, both of Ill.

[73] Assignee: Fel-Pro Incorporated, Skokie, Ill.

[21] Appl. No.: 15,364

[22] Filed: Feb. 17, 1987

[51] Int. Cl.[4] ..... B25B 23/142

[52] U.S. Cl. ..... 73/862.23; 81/429

[58] Field of Search ..... 73/862.23, 862.21, 862.24, 73/761; 81/429

[56] References Cited

U.S. PATENT DOCUMENTS 2,365,419 12/1944 Lockheed .
2,734,412 2/1956 Orner .
2,796,674 6/1957 Ross .
2,889,729 6/1959 Orner .
4,265,109 5/1981 Hallbauer et al. .
4,608,872 9/1986 Mayer et al. ..... 73/862.23

FOREIGN PATENT DOCUMENTS 2914287 11/1980 Fed. Rep. of Germany ..... 81/429

*Primary Examiner*—Charles A. Ruehl
*Attorney, Agent, or Firm*—Dressler, Goldsmith, Shore, Sutker & Milnamow, Ltd.

[57] ABSTRACT

A torque to yield indicator and method. An indicator and dial members are coaxially mounted relative to the shank of a torque wrench. One corotates with the shank; the other is freewheeling. After the specified torque load is applied to a fastener, the freely rotatable member is held against movement. When the torque wrench is further rotated, the dial and scale on the members show the amount of relative angular movement which is stopped when the preselected amount of rotation has occurred.

11 Claims, 1 Drawing Sheet

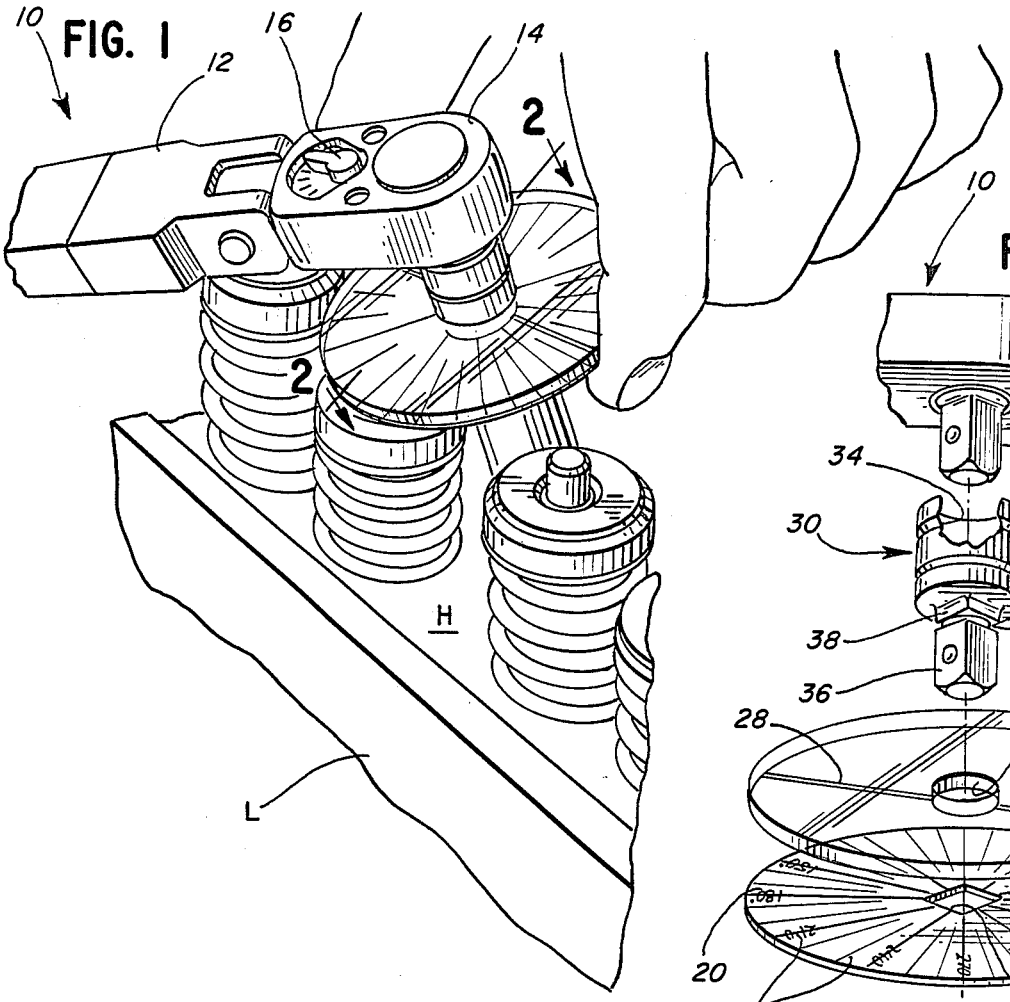
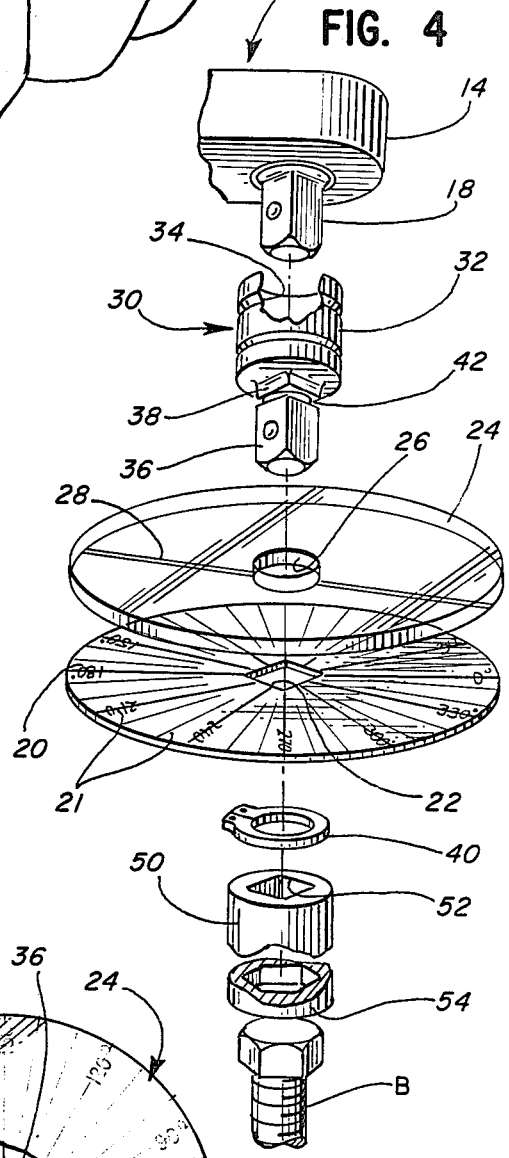
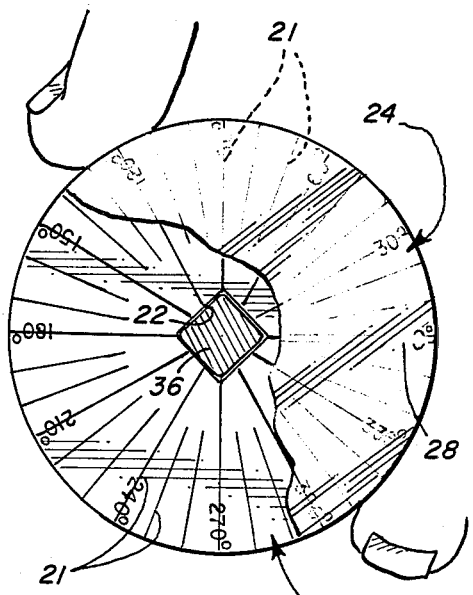
FIG. 2
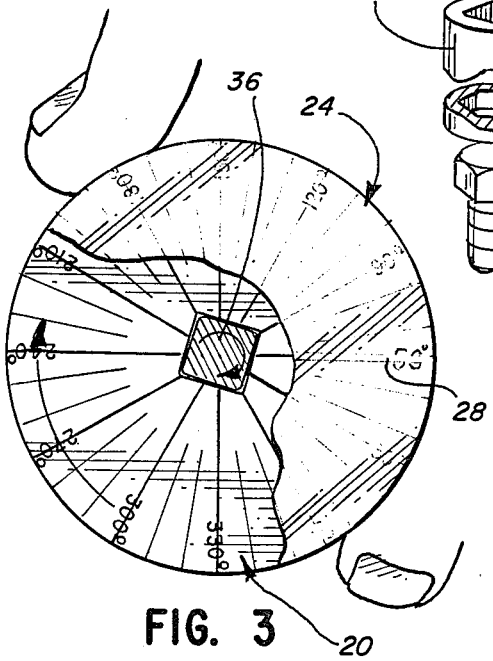
FIG. 3

TORQUE TO YIELD INDICATOR AND METHOD

BACKGROUND OF THE INVENTION

A wide variety of torque wrenches and torque indicating devices for use in association with such wrenches are available. Generally these are used to signal when a given torque has been achieved, or are otherwise concerned with providing readings related to the actual torque load itself. In other situations, where solely the angle through which a threaded member is to be turned, such as 80°, without regard to a specific final load or tension after an initial torque load is applied, is to be the determinant of final torquing, frequently guess-work as to the angle is utilized, thereby resulting in substantial variation in, and departure from, the specified final torquing. It would therefore be desirable to provide an improved method and device for insuring proper and specified torquing of threaded members such as fasteners for load plus angle torquing.

SUMMARY OF THE INVENTION

In accordance with the present invention there is provided a torque angle indicator for signifying when the driven shank of a torque wrench has been rotated through a preselected number of degrees in a tightening direction after a preselected torque has first been applied to a threaded member. The torque indicator includes a first rotatable member mounted for corotation with the shank and a second rotatable member mounted for rotation relative to the shank and in confronting relation to the first rotatable member.

One of the rotatable members defines a reference indicator and the other defines a desired scale, and preferably a subdivided circular scale. Means are provided for securing the rotatable members in the confronting relationship, so that when the driven shank is rotated and the second rotatable member is secured and held against rotation relative to the shank, the first member will rotate relative to the second member and the reference indicator will rotate relative to the scale, such that further rotation of the shank may be discontinued when the predetermined degree of movement is indicated on the scale.

Desirably the first member defines the scale and the second member defines the reference indicator. In a preferred form, the means for securing the members in their confronting relationship comprises an adaptor also for coupling the driven shank to a threaded member driver, the members being mounted on the adaptor. For corotatably mounting one member relative to the driven shank, the member may define a key means and the adaptor may define a complementary key.

A preferred method in accordance with the present invention is for insuring specified torquing of a threaded element to a preselected number of degrees of rotation after torquing to a first predetermined amount with a torque wrench comprises the steps of providing a pair of rotatable members coaxial with the driven shank of a torque wrench, one of which is keyed for rotation with the shank, and one of which is freely rotatable relative to the shank, the rotatable members defining indicia providing, respectively, a circular scale and an indicator, and holding the freely rotatable member against rotation as the driven shank is rotated, whereby the indicator will signify when rotation by the preselected number of degrees as shown by the circular scale has occurred. In a preferred form the rotatable members are circular and the step of holding comprises gripping the freely rotatable member at its periphery to prevent rotation of said freely rotatable member relative to the driven rotatable member as it corotates with the driven shank.

Further objects, features and advantages of the present invention will become apparent from the following description and drawings.

BRIEF DESCRIPTION OF THE DRAWINGS

FIG. 1 illustrates a torque angle indicator juxtaposed with a cylinder head for use in accordance with the present invention;

FIG. 2 is a plan view partially cut away, of the torque angle indicator of FIG. 1, taken substantially along line 2—2 of FIG. 1;

FIG. 3 is a view, like that of FIG. 2, with the torque angle indicator rotated from the position of FIG. 2; and FIG. 4 is an exploded perspective view of the torque angle indicator of FIG. 1, as shown in association with a typical torque wrench.

DESCRIPTION OF A PRESENTLY PREFERRED EMBODIMENT

The drawings show a presently preferred embodiment of the present invention which employs a conventional torque wrench 10. Wrench 10 includes a handle 12 having a head portion 14 and an adjustor 16 for selecting the torque to be applied, as to a threaded member such as a fastener or bolt B (FIG. 4). Torque is applied through a driven shank 18. Shank 18 is adapted to corotate with the head and handle, thereby to apply a torquing force to the bolt B.

As shown in FIG. 1, fasteners such as bolts B, are used to secure the head H of an engine to a block L. Typically preselected loads are to be applied to the bolts, thereby predeterminatively to clamp the head and block, and interposed head gasket, to each other at given loads.

As best seen in FIG. 4, the torque angle indicator of the present invention includes a pair of rotatable members which are coaxial with the driven shank and means for securing them in a confronting relationship. Preferably the members are of transparent plastic material. Thus a first generally circular rotatable member or dial 20 is provided. It defines and is subdivided into a circular scale, such as in ten degree (10°) dial increments 21. Centrally, rotatable dial member 20 defines a key means, which, in the illustrated embodiment, is a generally square hole 22.

The second generally circular rotatable member or indicator 24 is configured to confront dial 20 and to be rotatable relative thereto. It too defines a central opening 26 which may be circular. Indicator 24 defines a reference indicator 28 which may be an imprinted, embossed or engraved line located to be aligned with the lines comprising the circular scale on dial 20.

The dial 20 and indicator 24 are mounted, respectively, for rotation with and relative to the driven shank 18 and to this end are mounted on a coupler 30. Coupler 30 has an enlarged end 32 defining a socket 34 to receive shank 18 in a tight fit so that they will corotate. The other end of coupler 30 is reduced in size and defines a shank 36, and a key 38 which is proportioned to snugly be received within the dial hole 22. It is thus apparent that dial 20 will corotate with shank 18 and coupler 30 when they are rotated.

Indicator 24 is disposed in an overlying confronting relationship to dial 20. The opening 26 is sized so that indicator 24 is freewheeling relative to the coupler 30 and to key 38 upon which it is seated. A split washer 40 is provided to be snap secured to coupler 30 in a zone 42 of reduced diameter immediately below key 38.

As will be appreciated shank 36 of coupler 30 is proportioned to be secured to a bit 50 which defines a complementary opening 52 for the shank, thereby making it corotatable with coupler 30 and driven shank 18. The lower end of the bit 50 defines a socket 54 which mates with the head of the bolt B, such as the hexagonal head of the bolt as illustrated.

Thus it will be apparent that when handle 12 of torque wrench 10 is rotated, both the bolt B and the dial 20 will rotate therewith. It will also be apparent that the indicator 24 may be secured or held against corotation thereby to provide a means for indicating the angle through which the dial 20 has been rotated so that when a selected rotation has occurred, such may be made known.

To that end, in one manner of practicing the invention, when one is ready to turn the fastener through a preselected number of degrees to be discerned by relative rotation of the dial 20 and the indicator 24, the user may align the diametric reference indicator 28 with the 0°–180° line on the dial, as is typically illustrated in FIG. 2. The user may then grip the indicator at opposite sides so that it will slip and not move as the handle 12, shank 18, coupler 30 and dial 20 rotate. After they have rotated the preselected amount, say 60° as illustrated by FIG. 3, rotation may be stopped. Thus this provides a highly expedient and simple manner of indicating when the fastener has been tightened to a specified load.

One typical environment in which the torque indicator of the present invention may be used is, as suggested above, in clamping a head gasket between the head and block of an internal combustion engine. A typical specification for applying clamping load is defined as applying a preset load, such as a set number of foot pounds, to be followed by further tightening through an angle of a specified number of degrees of rotation. This for a particular engine and gasket will suitably stress the bolts. The loads and angles will vary depending upon the specification for the particular application. Other applications for the torque indicator of the invention will be apparent to those skilled in the art as well.

It will be apparent that the indicia on the dial 20 and indicator may be reversed and that, for example, the reference indicator 24 need not be a full circular member.

In use, the torque wrench 10 is set via adjuster 16 to signify a predetermined torque. A signal such as an audible click or clicks is provided to signify when the desired torque load has been applied. At that time, the operation for which the present invention is intended commences, i.e., the use of the torque angle indicator is implemented.

The operator then sets the indicator relative to the dial or observes the position of the indicator relative to the dial. The operator then holds and secures the rotatable indicator against movement relative to the dial, as by squeezing and gripping the periphery of the indicator 24 between a thumb and forefinger. At that point, further rotation of the torque wrench handle is initiated which causes the dial member to rotate relative to the indicator, while continuing the tightening of the threaded element F. The dial member slips past the thumb and forefinger. After the preselected rotation as indicated by the stationary reference indicator has occurred, further rotation is discontinued.

This provides a convenient, positive means for consistently and easily assuring that the preselected angle through which the threaded member is to be turned after the predetermined torque has been applied has occurred.

It will be apparent to those skilled in the art that numerous modifications may be made without departing from the spirit and scope of the present invention. Accordingly it is intended that the invention not be limited except insofar as may be necessary in light of the claims.

What is claimed is:

1. A torque angle indicator for signifying when the driven shank of a torque wrench has been rotated through a predetermined number of degrees in a tightening direction after a preselected torque has first been applied to a threaded member, a first rotatable member mounted for corotation with said shank, a second rotatable member mounted for rotation relative to said shank and in close, expansive confronting relation to said first member, one of said rotatable members defining a reference indicator and the other of said members defining a desired scale, and means for securing said members in said close, expansive confronting relationship and for holding said first member for corotation with said securing and holding means, said securing and holding means further defining means for corotatably cooperating with a said driven shank, whereby when said driven shank is rotated and said first rotatable member is secured to said shank for corotation with said securing and holding means and said second rotatable member is held against rotation, said first member will rotate relative to said second member and as such said reference indicator will move relative to said scale, and further rotation of said shank may be discontinued when said predetermined degree of movement is indicated.

2. A torque angle indicator in accordance with claim 1, and wherein said first member defines said desired scale and said second member defines said reference indicator, and wherein said first and second members are generally circular.

3. A torque angle indicator in accordance with claim 1, and wherein said first rotatable member defines a key means for keying with said securing and holding means whereby said first member is keyed for corotation with said shank.

4. A torque angle indicator in accordance with claim 1, and wherein said means for corotatably cooperating with said driven shank includes a socket defining portion for receiving the shank of a torque wrench, and said securing and holding means further includes a shank defining portion for securance to a driving bit.

5. A method for insuring specified torquing of a threaded element to a preselected number of degrees of rotation after torquing to a first predetermined amount with a torque wrench, the method comprising the steps of:

providing a pair of rotatable members coaxial with the driven shank of the torque wrench, one of which is keyed for corotation with said shank and one of which is freely rotatable relative to the shank, said rotatable members defining indicia providing, respectively, a circular scale, and an indicator, and holding the freely rotatable member against rotation as the driven shank is rotated, whereby said indicator will signify when rotation by the preselected number of degrees as shown by said circular scale has occurred.

6. The method in accordance with claim 7, and wherein said rotatable members are generally circular and said step of holding comprises gripping the freely rotatable member at its periphery to prevent rotation of said freely rotatable member relative to said driven rotatable member as it corotates with said driven shank.

7. A torque angle indicator for signifying when the driven shank of a torque wrench has been rotated through a predetermined number of degrees in a tightening direction after a preselected torque has first been applied to a threaded member, a first rotatable member mounted for corotation with said shank, a second rotatable member mounted for rotation relative to said shank and in confronting relation to said first member, one of said rotatable members defining a reference indicator and the other of said members defining a desired means securing said members in said confronting relationship, said securing means including an adaptor for coupling said driven shank to a threaded member driver, and wherein said first and second members are mounted on said adaptor, whereby when said driven shank is rotated and said second rotatable member is secured against rotation with respect to said shank, said first member will rotate relative to said second member and as such said reference indicator will move relative to said scale, and further rotation of said shank may be discontinued when said predetermined degree of movement is indicated.

8. A torque angle indicator in accordance with claim 7, and wherein said adaptor defines a key and said first member defines a complementary key means for keying said first member for corotation with said adaptor.

9. A torque angle indicator in accordance with claim 7, and wherein said adaptor includes a socket defining portion for receiving the shank of a torque wrench, and a shank defining portion for securance to a driving bit.

10. A torque angle indicator for signifying when the driven shank of a torque wrench has been rotated through a predetermined number of degrees in a tightening direction after a preselected torque has first been applied to a threaded member, a first rotatable member mounted for corotation with said shank, a second rotatable member mounted for rotation relative to said shank and in confronting relation to said first member, one of said rotatable members defining a reference indicator and the other of said members defining a desired scale, said member defining said scale being subdivided into a circular scale and defining a key means for keying said first member for corotation with said shank and said member defining said reference indicator being mounted for rotation relative to the other member, and means securing said members in said confronting relationship, said securing means comprising an adaptor coupled to said driven shank and keyed to said key means, whereby when said driven shank is rotated and said second rotatable member is secured against rotation with respect to said shank, said first member will rotate relative to said second member and as such said reference indicator will move relative to said scale, and further rotation of said shank may be discontinued when said predetermined degree of movement is indicated.

11. A method for insuring specified torquing of a threaded element to a preselected number of degrees of rotation after torquing to a first predetermined amount with a torque wrench, the method comprising the steps of:

providing a torque wrench having a driven shank, providing an elongated adaptor defining a driven shank receiving socket at one end complementary in shape to said driven shank for corotation therewith, said adaptor further defining a shank at its other end for cooperation with a bit having a complementary socket, providing a pair of rotatable members coaxial with the driven shank of the torque wrench on said adaptor between said ends, one of which members is secured for corotation with said driven shank and one of which is freely rotatable relative to said driven shank, said rotatable members defining indicia providing a circular scale on one member and an indicator on the other member, and holding the freely rotatable member against rotation as the driven shank is rotated, whereby said indicator will signify when rotation by the preselected number of degrees as shown by said circular scale has occurred.

* * * * *

UNITED STATES PATENT AND TRADEMARK OFFICE

CERTIFICATE OF CORRECTION

PATENT NO. : 4,760,746

DATED : August 2, 1988

INVENTOR(S) : Gregory M. Kruse and Harold P. Patton

It is certified that error appears in the above-identified patent and that said Letters Patent is hereby corrected as shown below:

Column 5, line 29, after "desired" insert --scale, and--.

Signed and Sealed this

Thirteenth Day of December, 1988

*Attest:*

DONALD J. QUIGG

*Attesting Officer*

*Commissioner of Patents and Trademarks*